US006834637B1

(12) United States Patent
Sharpton

(10) Patent No.: US 6,834,637 B1
(45) Date of Patent: Dec. 28, 2004

(54) ADAPTER FOR AN IDLE AIR CONTROL VALVE

(75) Inventor: A. DeWayne Sharpton, Stillwater, OK (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 10/836,485

(22) Filed: Apr. 30, 2004

(51) Int. Cl.[7] ..... F02M 3/00
(52) U.S. Cl. ..... 123/339.1; 123/337
(58) Field of Search ..... 123/339.1, 339.12, 123/337, 184.46, 184.49, 184.59

(56) References Cited

U.S. PATENT DOCUMENTS

| | | | | |
|---|---|---|---|---|
| 3,963,670 A | | 6/1976 | Kalert et al. | 261/41 D |
| 4,053,543 A | | 10/1977 | Pettitt | 261/121 B |
| 4,181,108 A | | 1/1980 | Bellicardi | 123/119 EC |
| 4,337,742 A | | 7/1982 | Carlson et al. | 123/339 |
| 4,452,201 A | | 6/1984 | Mazure et al. | 123/339 |
| 5,394,846 A | | 3/1995 | Jaeger et al. | 123/336 |
| 6,158,417 A | | 12/2000 | Rauch et al. | 123/399 |
| 6,394,424 B2 | | 5/2002 | Pattullo et al. | 261/35 |
| 6,446,599 B1 | * | 9/2002 | Nakayasu | 123/339.23 |
| 6,539,917 B2 | * | 4/2003 | Shaw et al. | 123/339.1 |
| 6,647,956 B1 | | 11/2003 | Sharpton | 123/339.1 |

* cited by examiner

*Primary Examiner*—Bibhu Mohanty
(74) *Attorney, Agent, or Firm*—William D. Lanyi

(57) ABSTRACT

An adapter for an air valve, such as an idle air control valve, has a rigid tubular member extending between a distal insertion end and an attachment pedestal end. The insertion member, or distal end, is rigidly attached to an air passage of a throttle body and an idle air control valve is rigidly attached to the attachment end. This allows an idle air control valve to be rigidly mounted to a throttle body while being displaced from the throttle body and held in a non contact association with the throttle body to allow different variations and styles of idle air control valve to be used with various types of throttle bodies.

20 Claims, 4 Drawing Sheets

ADAPTER FOR AN IDLE AIR CONTROL VALVE

BACKGROUND OF THE INVENTION

1. Field of the Invention

The present invention is generally related to an adapter for an idle air control valve and, more particularly, to an adapter which rigidly attaches an idle air control valve to a throttle body while maintaining the idle air control valve at a position which is displaced from the throttle body and disposed in non contact relation with the throttle body.

2. Description of the Prior Art

As is generally known by those skilled in the art, idle air control valves are used to allow a preselected amount of air to bypass a closed throttle plate when an internal combustion engine is being operated at idle speed. The idle air control valve is typically controlled by reaction to pressure changes or electronically by signals received from an engine control unit (ECU). Idle air control valves can comprise linear valves or stepper motors to adjust the amount of air that is allowed to bypass the throttle plate.

U.S. Pat. No. 4,452,201, which issued to Mazur et al. on Jun. 5, 1984, describes an automatic idle speed actuator valve. An auxiliary air bypass actuator valve of small size is disclosed which provides a quick response to the changing RPM of the engine due to changing loads. The actuator employs a stationary D-shaped orifice in communication with a rotatable valve member and a D-shaped disk to regulate the amount of auxiliary air which bypasses the throttle blade in an electronic fuel injection system.

U.S. Pat. No. 6,647,956, which issued to Sharpton on Nov. 18, 2003, discloses a sound attenuating system for a marine engine. A sound attenuator is provided for an idle air control valve system in order to reduce noise emanating from the idle air control valve. The sound attenuator comprises a fibrous pad that is inserted into an air conduit of the idle air control system. In a preferred embodiment, the fibrous pad is inserted into the air conduit near the air inlet where the conduit receives air from a region upstream, or above the throttle plate. A small hole can be provided through the air inlet. In certain embodiments, the air inlet of the air conduit is an opening formed in an inner cylindrical surface of the throttle body. In alternative embodiments, the air inlet can be remote from the internal surface of the throttle body.

U.S. Pat. No. 5,394,846, which issued to Jaeger et al. on Mar. 7, 1995, discloses a throttle body assembly. A dual bore throttle body assembly for a marine engine is described. The assembly includes a body having a pair of side by side bores, each of which is adapted to be enclosed by a flat throttle valve. A separate shaft is connected to each throttle valve and a throttle cable is connected to the shafts through a progressive linkage. The linkage is constructed such that only one of the valves is initially opened, and when that valve is approximately fifty percent open, the second valve is then opened. The speed of opening of the second valve is greater than that of the first valve so that both valves will reach the full opened position at the same time. Each shaft is provided with a longitudinal slot which receives the respective throttle valve, and the valves are secured within the slots by mechanical fasteners such as screws.

U.S. Pat. No. 6,158,417, which issued to Rauch et al. on Dec. 12, 2000, describes a throttle body accommodation of either an idle air control valve or a motorized throttle control. A throttle body has a first body part containing an upstream portion of the through bore and a second body part containing a downstream portion of the through bore. The two body parts are joined together to register a downstream portion of the through bore as a continuation of the upstream portion at respective confronting faces of the two body parts, capturing at least one bearing assembly of a throttle mechanism between the confronting faces to thereby journal a throttle shaft on opposite wall portions of the throttle body. The two body parts also contain a bypass air passage. In one form an idle air control valve associates with the bypass passage; in another, an electric motor actuator associates with the passage and with the throttle shaft.

U.S. Pat. No. 6,394,424, which issued to Pattullo et al. on May 28, 2002, describes a carburetor with diaphragm type fuel pump. For a four stroke engine, a carburetor with a fuel pump diaphragm which defines a fuel pump chamber on one side and a pressure pulse chamber on the other side in communication with the engine to receive pressure pulses which actuate the fuel pump diaphragm to draw fuel into the carburetor and to discharge fuel under pressure to a downstream fuel metering assembly is described. An air passage communicates an air supply with the pressure pulse chamber to provide an air flow within the pressure pulse chamber which sweeps away, dries out or aerates and removes any liquid within the pressure pulse chamber to avoid puddling of liquid fuel therein. In one form, a throttle valve carried by the carburetor body for movement between idle and wide open positions also actuates a valve which controls the flow of fluid through the air passage as a function of the position of the throttle valve.

U.S. Pat. No. 4,181,108, which issued to Bellicardi on Jan. 1, 1980, describes a system for the control of the composition of the fuel air mixture in an internal combustion engine. The system comprises an electromagnetically operated valve for controlling the supply of air to the main and idle ducts of each carburetor stage to vary the fuel air mixture in response to a signal from an oxygen concentration probe disposed upstream of the catalytic converter in the exhaust system of an internal combustion engine. The device is mounted on the vehicle structure rather than the engine and is comprised of a rotary cam disposed in operative relation with the plurality of metering valves to control the air supply from a single conduit leading from the air filter to a plurality of conduits leading to the various carburetor ducts.

U.S. Pat. No. 3,963,670, which issued to Kalert et al. on Jun. 15, 1976, describes an integrated idle and bypass system. A carburetor is disclosed which includes a supplemental fuel/air supply circuit for bypassing a throttle valve to provide a fixed fuel/air idle mixture. The supplementary fuel/air supply circuit includes separate fuel and air passageways which join at a mixing intersection. The mixing intersection communicates with a main bore of the carburetor at a point below a throttle valve thereof. The supplementary fuel/air supply circuit also includes a piston valve, which is responsive to manifold vacuum, to control flow of air through the air passageway so that the air passageway is open during periods of high manifold vacuum but closed during periods of low manifold vacuum.

U.S. Pat. No. 4,053,543, which issued to Pettitt on Oct. 11, 1977, describes an air bleed control for carburetor idle system. A carburetor for an internal combustion engine has an idle or low speed system in which air is bled into the idle fuel passage. An air bleed valve member controls the amount of air through an air bleed port for the idle fuel passage and a diaphragm operated control is connected to the air bleed control member to control the movement of the valve member. The diaphragm operated control has an air chamber on one side of the diaphragm and a vacuum chamber on the other side of the diaphragm with a restricted opening between the air and vacuum chambers.

U.S. Pat. No. 4,337,742, which issued to Carlson et al. on Jul. 6, 1982, describes an idle air control apparatus for internal combustion engine. The idle air control apparatus for a vehicle driving internal combustion engine has an air induction passage and includes a control valve in the air induction passage controlled by a stepper motor in response to the arithmetic count of applied electrical pulses. It also has a register effective to store a valve control number representing the currently desired position of the control valve and an apparatus effective upon occurrence of a predetermined engine loading event to change the valve control number in response thereto. It has an up-down counter effective to arithmetically count the pulses applied to the stepper motor and thus indicate actual control valve position. A closed loop control is effective to compare the contents of the up-down counter and register and apply pulses to the stepper motor at the first predetermined rate to reduce any difference therebetween and a speed trim loop active only during occurrence of a predetermined steady state idle condition to compare actual engine speed with the desired engine idle speed and arithmetically change the valve control number in the register at a second predetermined rate substantially lower than the first predetermined rate. This reduces any difference between the speeds. The idle air control device responds to is large, sudden engine load changes and environmental factors to prevent engine stall but ignores small random speed fluctuations to maintain a stable engine idle.

The patents described above are hereby expressly incorporated by reference in the description of the present invention.

Many different styles of throttle body structures are used in conjunction with internal combustion engines. Furthermore, many different styles of idle air control valves are used in conjunction with internal combustion engines. When a throttle body provided by one supplier is combined with an idle air control valve provided by a different supplier, it is often necessary to mount the idle air control valve separately and at a location that is displaced from the location of the throttle body. In addition, because the basic structure of the idle air control valve is not likely to be easily attachable to the basic structure of the throttle body, remote attachment of the idle air control valve to the engine is often necessary. When the idle air control valve is attached at a remote location relative to the throttle body of the internal combustion engine, it is necessary to provide various air conduits or hoses so that air can properly be directed in desirable directions so that the idle air control valve can control the amount of air that bypasses the throttle plate when the internal combustion engine is operating at idle speed. If the idle air control valve must be remotely mounted with respect to the throttle body, the conduits or hoses used to provide the flow of air can result in restricted air movement to and from the idle air control valve. Furthermore, the necessity to mount an idle air control valve remotely with respect to the throttle body necessitates additional support components and often increases assembly time and expense.

It would therefore significantly beneficial if an adapter could be provided that allows idle air control valves of various designs and styles to be rigidly attached to a throttle body without the need for numerous conduits and connectors to conduct air to and from the idle air control valve.

SUMMARY OF THE INVENTION

An air valve adapter, made in accordance with a preferred embodiment of the present invention, comprises a generally rigid tubular member having a central fluid passage formed therein and having first and second ends, an insertion member connected to the first end of the tubular member wherein the insertion member is shaped to be received in an air passage of a throttle body, and an attachment member connected to the second end of the tubular member. The attachment member is shaped to receive an air valve on a mounting surface of the attachment member. The tubular member is shaped to support an air valve at a position which is displaced from the throttle body with the air valve being disposed in non contact association with the throttle body. The tubular member is disposed between the throttle body and the air valve.

In a particularly preferred embodiment of the present invention, the first end of the tubular member is closed and a first opening is formed through a cylindrical wall of the first end of the insertion member. The first opening is disposed in fluid communication with the central passage of the tubular member. A second opening is formed through the mounting surface of the attachment member with the second opening being in fluid communication with the central fluid passage of the tubular member. A third opening is formed through the mounting surface of the attachment member and is in fluid communication between the mounting surface and a source of ambient air. The second opening is in fluid communication with the first opening formed through the cylindrical wall of the insertion member to allow a flow of fluid through the central fluid passage of the generally rigid tubular member.

In a preferred embodiment of the present invention, a flange extends radially outward from the tubular member and has at least two bolt holes formed therethrough. The flange is configured to attach the adapter to the throttle body and retain the insertion member within the air passage formed in a throttle body of an engine. The tubular member extends from the attachment member along an axis which is generally nonperpendicular to the mounting surface in a particularly preferred embodiment of the present invention. The air valve is rigidly attached to the mounting surface and disposed in fluid communication with the second and third openings. The second and third openings are intermittently connectable in fluid communication with each other through the air valve. In a particularly preferred embodiment of the present invention, the air valve is an idle air control valve.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
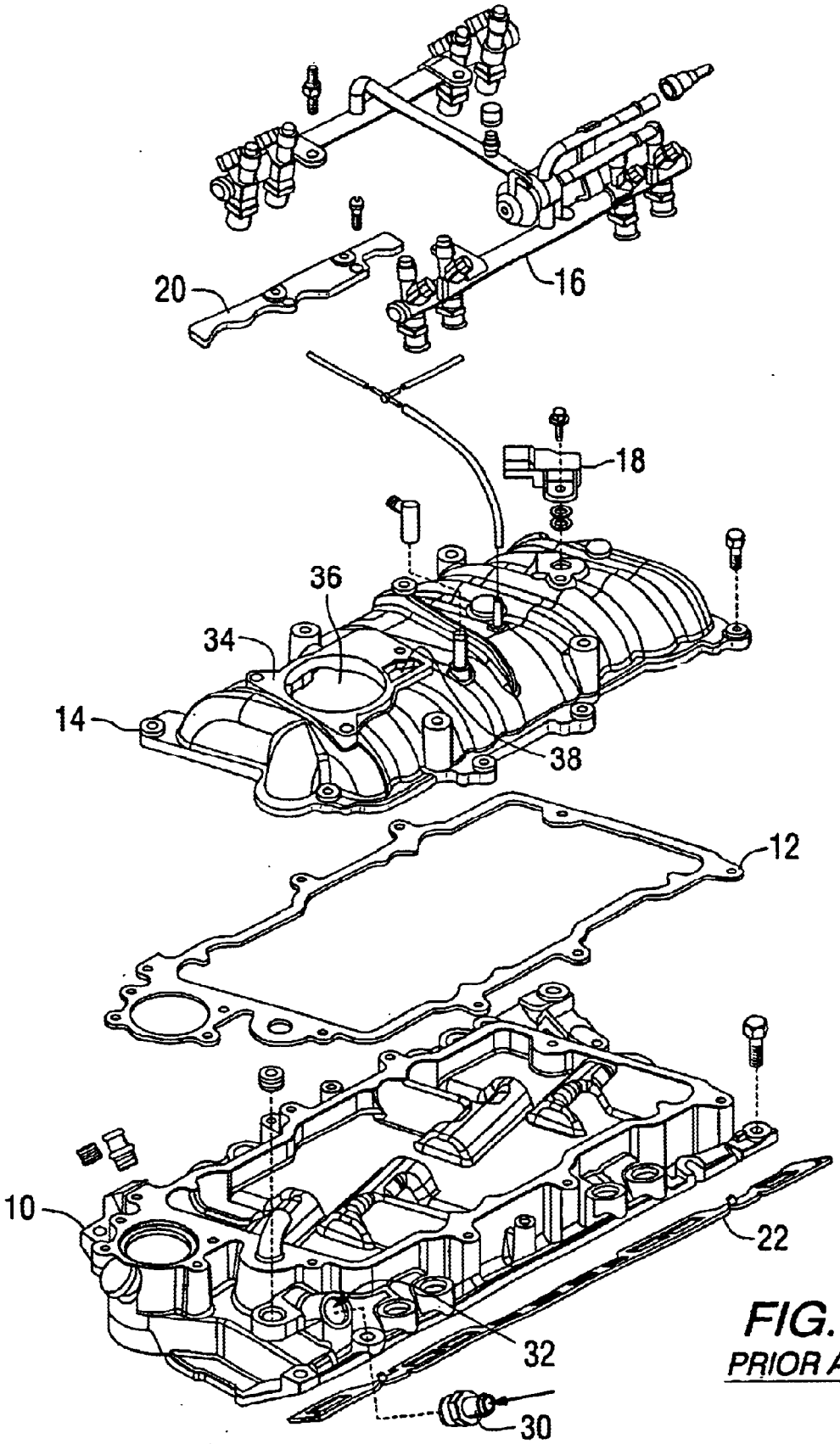
FIG. 1 PRIOR ART
FIG. 1 is an exploded isometric view of a known type of intake manifold structure.

Throughout the description of the preferred embodiment of the present invention, like components will be identified by like reference numerals.

Figure 2:
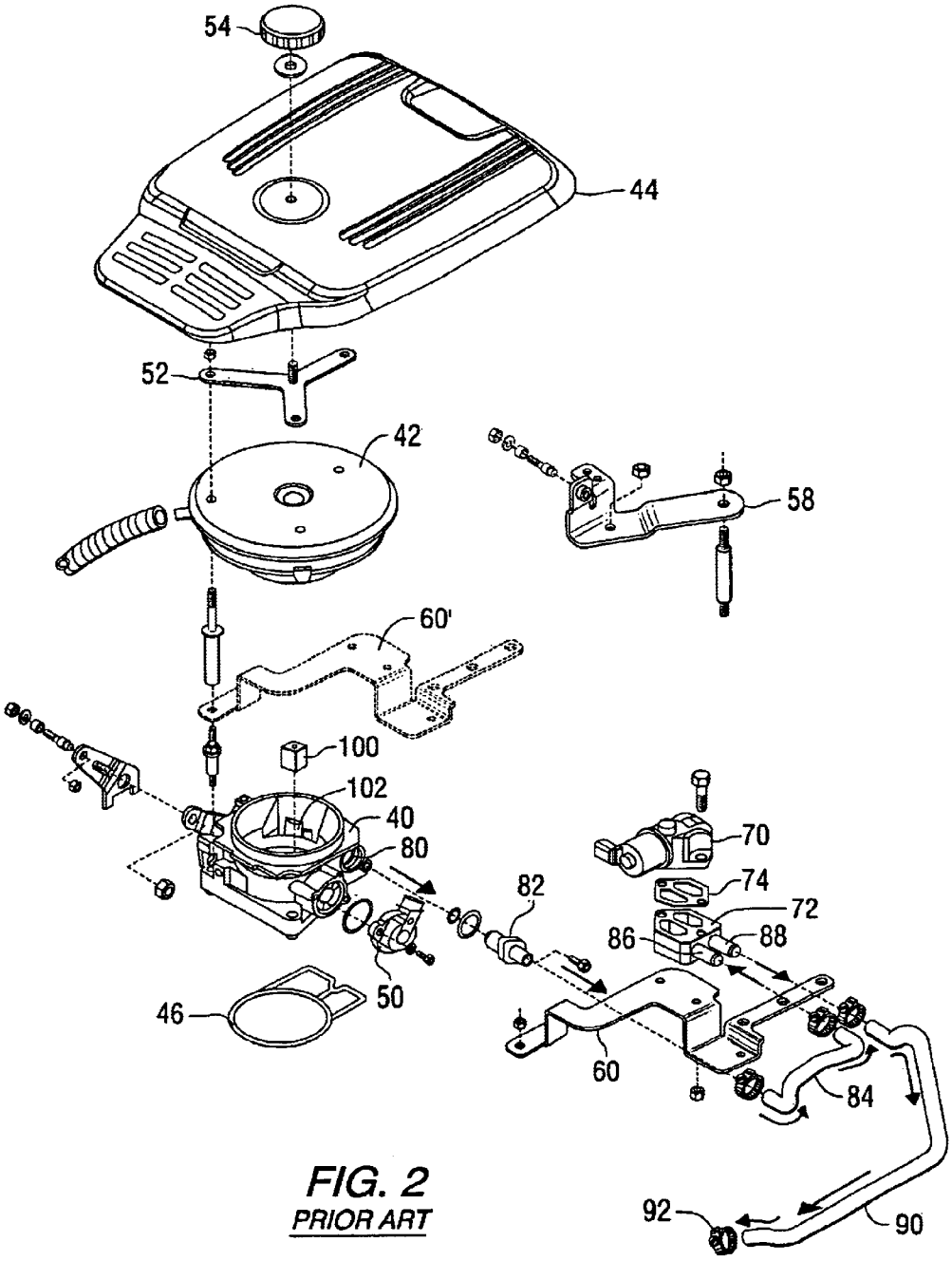
FIG. 2 PRIOR ART
FIG. 2 is an exploded isometric view of a known type of throttle body and idle air control valve assembly.

FIGS. 1 and 2 are provided to describe an environment in which the present invention provides a particular advantage. FIG. 1 shows an intake manifold and fuel rail assembly and FIG. 2 shows a throttle body. As will be described in greater detail below, various components illustrated in FIGS. 1 and 2 are connected in fluid communication with each other. This interconnection relates to a known system that is significantly improved by the present invention, as will be described below.

In FIG. 1, an intake manifold 10 is associated with a gasket 12 and an upper intake manifold housing 14. A fuel rail assembly 16 is attached to the upper intake manifold housing 14. Various other fittings and hardware are shown in FIG. 1, but will not be described in detail herein. A sensor 18, a bracket 20, and a gasket 22 are illustrated. It should be understood that the structure shown in FIG. 1 as an exploded isometric view is well known to those skilled in the art. A fitting 30 is shown relative to an opening 32 formed in the intake manifold 10. When the upper housing 14 is attached to the lower housing 10 of the intake manifold, a throttle body is attachable to a surface 34 to control the flow of air downwardly through opening 36 and into the main cavity of the air intake manifold formed by the combination of the upper 14 and lower 10 intake manifold housing members. As will be described in greater detail below, another opening 38 is formed through the mounting surface 34 to allow a controlled amount of air to flow around the throttle plate of a throttle body.

FIG. 2 is an isometric exploded view of a throttle body assembly in which a throttle body 40 is provided with a flame arrester 42, a cover 44, a gasket 46 to provide a seal between the lower portion of the throttle body 40 and surface 34 which is described above in conjunction with FIG. 1.

With continued reference to FIG. 2, a throttle position sensor 50 is also attached to the throttle body 40. A bracket 52 and a knob 54 is used to attach the cover 44 to the flame arrester 42 and throttle body 40. A throttle anchor bracket 58 and an idle air control valve bracket 60 are also illustrated in FIG. 2.

An idle air control valve 70 is provided with an air directing member 72 and 20 an air valve gasket 74. When in operation, air flows from an air passage 80 formed in the throttle body 40, through an adapter plug 82, through a first hose 84, into a port 86 in the air directing member 72, through the idle air control valve 70 (when it is in an open condition), out through a second port 88, through a second hose 90, and into the fitting identified by reference numeral 30 in FIG. 1. This directs the 25 flow of air into the opening 32 in the lower throttle body housing structure 10. In this way, the idle air control valve 70 can intermittently open and close to allow air to flow, under its control, into port 86 and out of port 88 to meter the proper amount of bypass air that flows around the throttle plate of the throttle body 40 when an internal combustion engine is operated at idle speed. The arrows in FIGS. 1 and 2 show the direction of flow of bypass air under the control of the idle air control valve 70. It should be understood that the end of the second hose 90 in FIG. 2, proximate hose clamp 92, is attached to the fitting 30 that is disposed in opening 32 of the lower intake manifold housing 10. For purposes of illustration, bracket 60 is shown as a dashed line representation 60' to more clearly illustrate its assembled position relative to the throttle body 40 and the flame arrester 42.

With continued reference to FIGS. 1 and 2, it can be seen that the bypass air must travel from the air passage 80 of the throttle body 40, through the adapter plug 82, and through the first and second hoses, 84 and 90, along with its passage through the idle air control valve 70 and the flow director 72 before entering opening 32 in the lower intake housing 10. This remote mounting of the idle air control valve 70, is often necessitated by the incompatibility of the mounting and air flow structure of the idle air control valve 70 in comparison to the type of throttle body 40 that is being used. Several disadvantages are inherent in the structure shown in FIGS. 1 and 2. First, the bypass air must flow through numerous restrictions as it flows in the directions represented by the arrows in FIGS. 1 and 2. These restrictions include the first and second hoses, 84 and 90, and the other points of connection along its path. A second disadvantage in the system shown in FIGS. 1 and 2 is the inherent cost disadvantage of assembling all of the components related to the idle air control valve 70 together in the manner illustrated.

Although the smaller items shown in FIGS. 1 and 2 will not be described in detail herein, it is helpful to note that the fibrous insert 100 shown in FIG. 2, which is inserted into opening 102 in the throttle body 40, is the fibrous insert which is described in detail in U.S. Pat. No. 6,647,956. It is intended to provide sound attenuation for the noise that could otherwise emanate from opening 102 which is caused by the idle air control valve 70. The air that flows, as represented by the arrows in FIGS. 1 and 2, from the throttle body 40 to opening 32 of the lower intake manifold housing 10 passes through the fibrous insert 100 as described in detail in U.S. Pat. No. 6,647,956.

With continued reference to FIGS. 1 and 2, it can be seen that a significant advantage could be obtained if the numerous components relating to the bracket 60, the air director 72, the first and second hoses 84 and 90, and the adapter fitting 30 in opening 32 could be eliminated. The present invention is directed to addressing that problem of restrictive air flow and complicated assembly.

Figure 4:
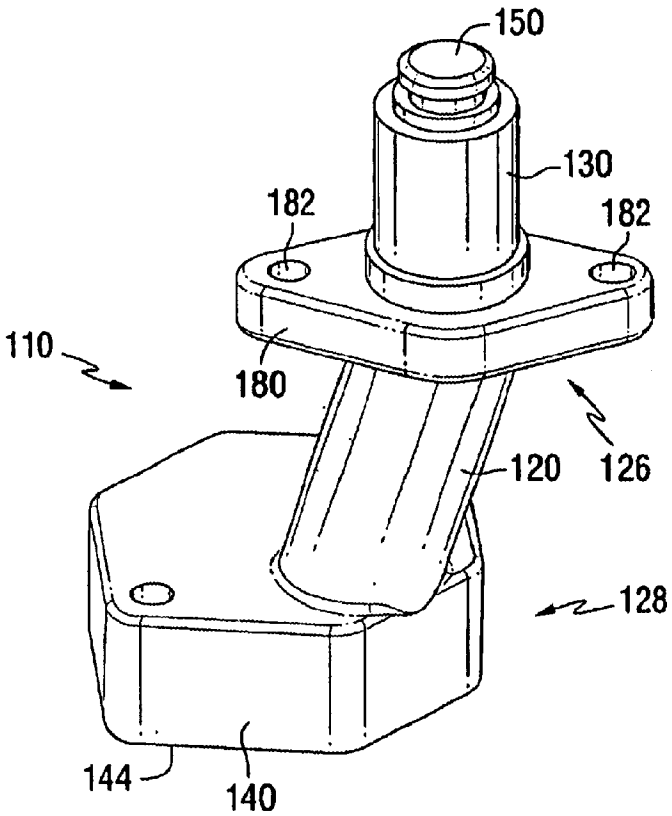
FIG. 4 is an isometric view of the present invention.
Figure 3:
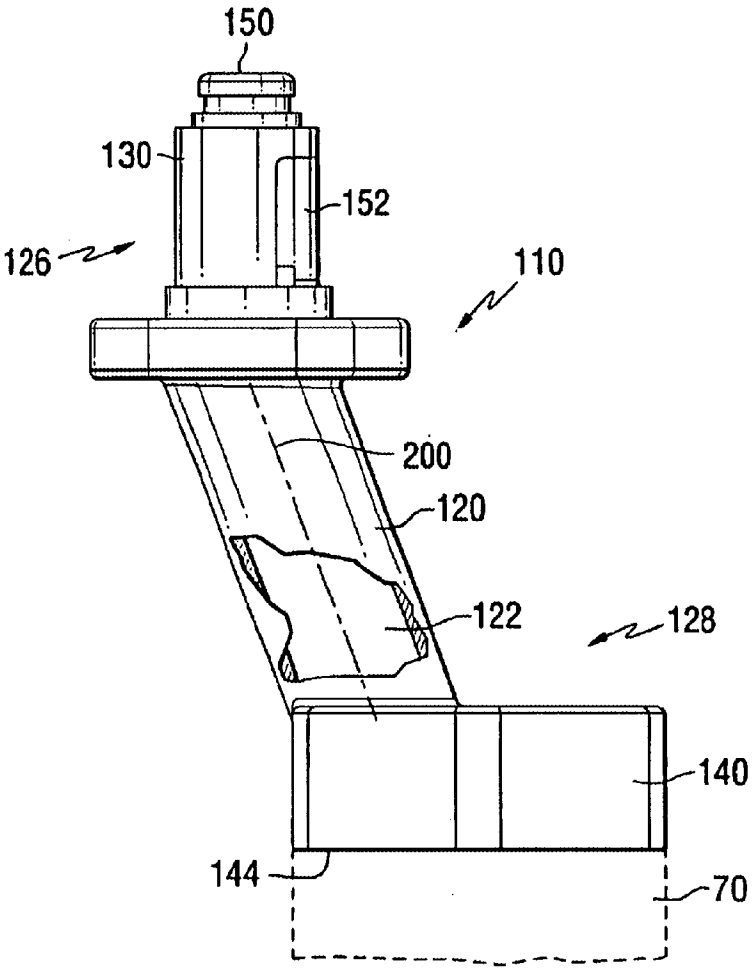
FIG. 3 is a side view of the present invention.

FIG. 3 is a side view of an air valve adapter 110 made in accordance with a preferred embodiment of the present invention. FIG. 4 is an isometric view of the air valve adapter of the present invention.

With reference to FIGS. 3 and 4, an air valve adapter 110 made in accordance with a preferred embodiment of the present invention comprises a generally rigid tubular member 120 which has a central fluid passage 122 formed therein. The tubular member 120 has a first end 126 and a second end 128. An insertion member 130 is connected to the first end 126 of the tubular member 120. The insertion member 130 is shaped to be received in an air passage 80 of a throttle body 40, which is described in conjunction with FIG. 2.

The insertion member 130 is described herein as being connected to the first end 126. However, in a particularly preferred embodiment of the present invention, this connection is provided by making the insertion member 130 an integral continuation of the tubular member 120. Alternatively, the insertion member 130 can be threaded into the tubular member 120 or welded to it. An attachment member 140 is connected to the second end 128 of the tubular member 120. The attachment member 140 is shaped to receive an air valve 70 in attachment with a mounting surface 144 of the attachment member 140. The tubular member 120 is shaped to support the air valve 70 at a position which is displaced from the throttle body 40 with the air valve 70 being disposed in non contact association with the throttle body 40. The tubular member 120 is disposable between the throttle body 40 and the air valve 70.

The attachment member 140, or attachment pedestal, can preferably be welded to the second end 128 of the tubular member 120.

With continued reference to FIGS. 3 and 4, the first end 126 of the tubular member 120 is closed, as represented by surface 150 which shows the closed end. A first opening 152 is formed through a cylindrical wall of the insertion member 130. The first opening 152 is in fluid communication with the central fluid passage 122 of the tubular member 120.

Figure 5:
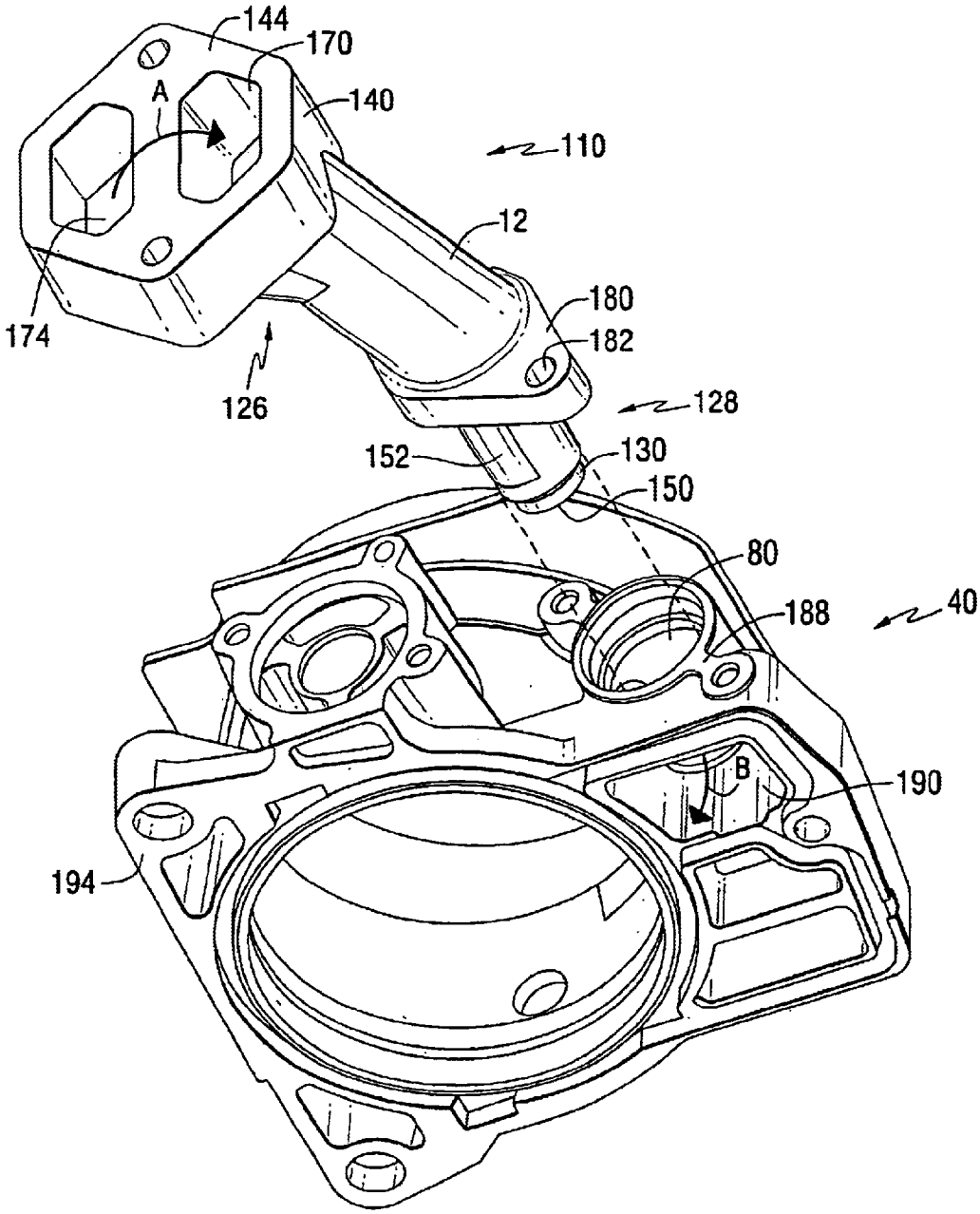
FIG. 5 is an exploded isometric view of the present invention associated with a throttle body.

FIG. 5 is an exploded isometric view of a throttle body 40 and the air valve adapter 110 of the present invention. FIG. 5 provides a view of the mounting surface 144 of the attachment member 140. A second opening 170 is formed through the mounting surface 144 of the attachment member 140 and is in fluid communication with the central fluid passage 122 of the tubular member 120, which is illustrated in FIG. 3. A third opening 174 is formed through the mounting surface 144 of the attachment member 140 and is in fluid communication between the mounting surface 144 and a source of ambient air. When an idle air control valve 70 is mounted to the mounting surface 144, it intermittently enables a flow of air to flow from the third opening 174, into the idle air control valve 70, and into the second opening 170 when the idle air control valve 70 permits this flow to occur. This is referred to as the bypass flow and is represented in FIG. 5 by arrow A. It should be understood that the bypass flow A actually flows from the third opening 174 into the idle air control valve 70 and then back into the second opening 170 before proceeding downwardly through the central fluid passage 122 toward the first opening 152 that is formed in the insertion member 130.

In FIG. 5, the insertion member 130 is shown with respect to the air passage 80 of the throttle body 40. When the insertion member 130 is inserted into the air passage 80, a flange 180 allows the air valve adapter 100 to be rigidly attached to the throttle body 40. This is accomplished by bolts that are inserted through the bolt holes 182 to firmly attach the flange 180 to the surface identified by reference numeral 188 on the throttle body 40. When the air passes out of the first opening 152 and into the cavity provided by the air passage 80, it then continues to flow, as represented by arrow B in FIG. 5, through an air opening 190 in the throttle body. That air opening 190 of the throttle body 40 is disposed in fluid communication with the opening 38 described above in conjunction with FIG. 1 when the surface 194 of the throttle body 40 is disposed on surface 34 of the upper intake manifold housing 14 and rigidly attached thereto.

The present invention provides a rigid mounting system by which an idle air control valve 70 can be attached to a mounting surface 144 of an attachment member 140 and displaced from the throttle body 40. In this way, the mounting surface 144 can be shaped and configured to accommodate many different types of idle air control valves 70. The air passage 80 and its surrounding structure need not be modified to accommodate these different types of idle air control valves 70. Therefore, one type of throttle body 40 can be used in combination with these various types of idle air control valves by simply configuring the adapter 110 to suit. Air is allowed to flow through the third opening 174 from the ambient surroundings near the throttle body 40. It can be silenced through the use of various types of sound attenuators, such as the type described in detail in U.S. Pat. No. 6,647,956 by simply associating the fibrous insert with the third opening 174. From there, the ambient air is allowed to flow into and through the idle air control valve 70 and downward into the second opening 170 to proceed through the central fluid passage 122.

With reference to FIGS. 3-5, it can be seen that the present invention provides an air valve adapter 110 which comprises a generally rigid tubular member 120 having a central fluid passage 122 formed therein. The tubular member 120 has a distal end 130 and a pedestal end 140. The distal end 130, or insertion member, of the tubular member 120 is shaped to be received in the air passage 80 of a throttle body 40. An attachment pedestal 140, or attachment member, is shaped to receive an idle air control valve 70 in attachment therewith. The tubular member 120 is shaped to support the air valve 70 at a position which is displaced from the throttle body 40, with the air valve 70 being disposed in non contact association with the throttle body 40. The distal end 130, or insertion member, of the tubular member 120 is closed at its terminus 150 and a first opening 152 is formed through a cylindrical wall of the distal end 130. The first opening 152 is in fluid communication with the central fluid passage 122 of the tubular member 120. A second opening 170 is formed through a surface 144 of the attachment pedestal 140 and is in fluid communication with the central fluid passage 122 of the tubular member 120. A third opening 174 is formed through the surface 144 of the attachment pedestal 140 and is in fluid communication with a source of ambient air. The second opening 170 is in fluid communication with the first opening 152 formed through the cylindrical wall of the insertion member 130, or distal end. The tubular member 120 extends from the attachment pedestal 140 along an axis 200 which is nonperpendicular to the mounting surface 144. This nonperpendicularity allows the idle air control valve 70 to be offset and displaced away from the air passage 80 of the throttle body 40. The idle air control valve 70 is rigidly attached to the attachment pedestal 140 and disposed in fluid communication with the second and third openings, 170 and 174. The second and third openings, 170 and 174, are intermittently connectable in fluid communication with each other through the idle air control valve 70.

Although the present invention has been described with particular specificity and illustrated to show a particularly preferred embodiment, it should be understood that alternative embodiments are also within its scope.

I claim:

1. An air valve adapter, comprising:

a generally rigid tubular member having a central fluid passage formed therein, said tubular member having a first end and a second end;

an insertion member connected to said first end of said tubular member, said insertion member being shaped to be received in an air passage in a throttle body; and an attachment member connected to said second end of said tubular member, said attachment member being shaped to receive an air valve in attachment with a mounting surface of said attachment member, said tubular member being shaped to support said air valve at a position which is displaced from said throttle body with said air valve being disposed in noncontact association with said throttle body, said tubular member being disposable between said throttle body and said air valve.

2. The adapter of claim 1, wherein:

said first end of said tubular member is closed.

3. The adapter of claim 1, further comprising:

a first opening formed through a cylindrical wall of said first end of said insertion member, said first opening being in fluid communication with said central fluid passage of said tubular member.

4. The adapter of claim 3, further comprising:

a second opening formed through said mounting surface of said attachment member, said second opening being in fluid communication with said central fluid passage of said tubular member.

5. The adapter of claim 4, further comprising:

a third opening formed through said mounting surface of said attachment member, said third opening being in fluid communication between said mounting surface and a source of ambient air.

6. The adapter of claim 4, wherein:

said second opening is in fluid communication with said first opening formed through said cylindrical wall of said insertion member.

7. The adapter of claim 1, further comprising:

a flange extending radially outward from said tubular member, said flange having at least two bolt holes formed therethrough, said flange being configured to attach said adapter to said throttle body and retain said insertion member within said air passage formed in a throttle body of an engine.

8. The adapter of claim 1, wherein:

said tubular member extends from said attachment member along an axis which is nonperpendicular to said mounting surface.

9. The adapter of claim 5, further comprising:

said air valve which is rigidly attached to said mounting surface and disposed in fluid communication with said second and third openings.

10. The adapter of claim 9, wherein:

said second and third openings are intermittently connectable in fluid communication with each other through said air valve.

11. The adapter of claim 1, wherein:

said air valve is an idle air control valve.

12. An air valve adapter, comprising:

a generally rigid tubular member having a central fluid passage formed therein, said tubular member having a distal end and a pedestal end, said distal end of said tubular member being shaped to be received in an air passage in a throttle body; and an attachment pedestal connected to said pedestal end of said tubular member, said attachment pedestal being shaped to receive an idle air control valve in attachment therewith, said tubular member being shaped to support said air valve at a position which is displaced from said throttle body with said air valve being disposed in noncontact association with said throttle body, said tubular member being disposable between said throttle body and said air valve.

13. The adapter of claim 12, wherein:

said distal end of said tubular member is closed; and a first opening formed through a cylindrical wall of said distal end of said insertion member, said first opening being in fluid communication with said central fluid passage of said tubular member.

14. The adapter of claim 13, further comprising:

a second opening formed through a surface of said attachment pedestal, said second opening being in fluid communication with said central fluid passage of said tubular member.

15. The adapter of claim 14, further comprising:

a third opening formed through said surface of said attachment pedestal, said third opening being in fluid communication with a source of ambient air.

16. The adapter of claim 14, wherein:

said second opening being in fluid communication with said first opening formed through said cylindrical wall of said insertion member.

17. The adapter of claim 12, wherein:

said tubular member extends from said attachment pedestal along an axis which is nonperpendicular to said mounting surface.

18. The adapter of claim 15, further comprising:

said idle air control valve which is rigidly attached to said attachment pedestal and disposed in fluid communication with said second and third openings.

19. The adapter of claim 15, wherein:

said second and third openings are intermittently connectable in fluid communication with each other through said idle air control valve.

20. An air valve adapter, comprising:

a generally rigid tubular member having a central fluid passage formed therein, said tubular member having a distal end and a pedestal end, said distal end of said tubular member being shaped to be received in an air passage in a throttle body, said distal end of said tubular member being closed;

an idle air control valve;

an attachment pedestal connected to said pedestal end of said tubular member, said attachment pedestal being attached to said idle air control valve, said tubular member being shaped to support said idle air control valve at a position which is displaced from said throttle body with said idle air control valve being disposed in noncontact association with said throttle body;

a first opening formed through a cylindrical wall of said distal end of said insertion member, said first opening being in fluid communication with said central fluid passage of said tubular member;

a second opening formed through a surface of said attachment pedestal, said second opening being in fluid communication with said central fluid passage of said tubular member, said second opening being in fluid communication with said first opening formed through said cylindrical wall of said insertion member;

a third opening formed through said surface of said attachment pedestal, said third opening being in fluid communication with a source of ambient air, said idle air control valve being rigidly attached to said attachment pedestal and disposed in fluid communication with said second and third openings, said second and third openings being intermittently connectable in fluid communication with each other through said idle air control valve, said tubular member being disposable between said throttle body and said air valve.

* * * * *